United States Patent [19]

Nakamura

[11] 3,941,081

[45] Mar. 2, 1976

[54] ALARM FOR A BICYCLE

[75] Inventor: Yoshihira Nakamura, Tokyo, Japan

[73] Assignee: Nakamura Sangyo Co., Ltd., Tokyo, Japan

[22] Filed: May 12, 1975

[21] Appl. No.: 576,290

[52] U.S. Cl. ..... 116/142 FP; 116/142 FV

[51] Int. Cl.[2] ..... G10K 9/02; G10K 9/04

[58] Field of Search .... 116/142 FS, 142 FV, 137 R, 116/139, 65; 46/180, 181, 178

[56] References Cited

UNITED STATES PATENTS

| | | | |
|---|---|---|---|
| 606,668 | 7/1898 | Hunter | 116/137 R |
| 677,113 | 6/1901 | Bruce | 116/139 |
| 3,813,811 | 6/1974 | Herter | 46/180 |

FOREIGN PATENTS OR APPLICATIONS

| | | | |
|---|---|---|---|
| 486,814 | 11/1929 | Germany | 116/139 |

*Primary Examiner*—S. Clement Swisher
*Assistant Examiner*—Denis E. Corr
*Attorney, Agent, or Firm*—Wenderoth, Lind & Ponack

[57] ABSTRACT

An alarm used for a bicycle having a cover member formed with a number of apertures, the cover member being disposed on a trumpet-like cylinder of the alarm. The alarm comprises a trumpet-like cylindrical body, a mounting piece receptacle bed formed integral with the cylindrical body, a vocal member encased in the cylindrical body, a bellows-like air blower bag, a cover member, and a mounting piece disposed opposite the receptacle bed. The alarm is designed so that air vibrations may be imparted to the vocal member when the air blower bag is biased and when moved back to its initial state.

1 Claim, 4 Drawing Figures

ALARM FOR A BICYCLE

BACKGROUND OF THE INVENTION

1. Field of the Invention

This invention generally relates to an alarm secured for use to a handle or the like of a bicycle and more particularly, to an improved alarm for a bicycle in which a cover member formed with a number of apertures is disposed on a trumpet-like cylindrical body of the alarm.

2. Description of the Prior Art

Prior art alarms for a bicycle are usually of the type in which the alarm has a cylindrical body which encases a vocal member or a sound making member at the base thereof, to which an air blower bag is connected, which air blower bag feeds air under pressure to cause vibration of the vocal member to thereby produce sounds. In such conventional alarms, however, the vibration may merely be imparted to the vocal member only when the air blower bag is biased. In addition, these alarms have been impossible to produce sounds high enough to achieve an alarming effect.

SUMMARY OF THE INVENTION

It is therefore an object of this invention to provide a novel alarm for a bicycle which is inexpensive and simple in operation, while overcoming and improving the structural disadvantages noted above with respect to prior art alarms.

It is a further object of this invention to provide an alarm for a bicycle which is capable of producing high sounds greater in the alarming effect.

It is another object of this invention to provide an alarm for a bicycle which is capable of producing sounds in either case, that is, as an air blower bag is biased and as it is moved back to its initial position.

These objects may be achieved by various parts which form the present invention, improvements thereof, combination, and operation. An embodiment of the present invention will be shown in the accompanying drawings and illustrated in the detail description hereinafter disclosed.

It will be noted that variations and modifications relating to the details of construction of the invention are to be included in the claim later described.

According to the present invention, there is provided an alarm for a bicycle wherein a vocal member is fixedly encased inwardly of a base portion in a trumpet-like alarm cylindrical body provided with a mounting piece to be secured to a handle or the like of the bicycle and a mounting piece receptacle bed for supporting said mounting piece and wherein a cover member of approximately inverted U-shaped in section, one end of which being closed and having a number of apertures formed in a pointed fashion, is adhered to a trumpet-like portion at the extremity of said cylindrical body which receives therein a bellows-like air blower bag through a guide cylinder.

DESCRIPTION OF THE PREFERRED EMBODIMENT

Figure 1:
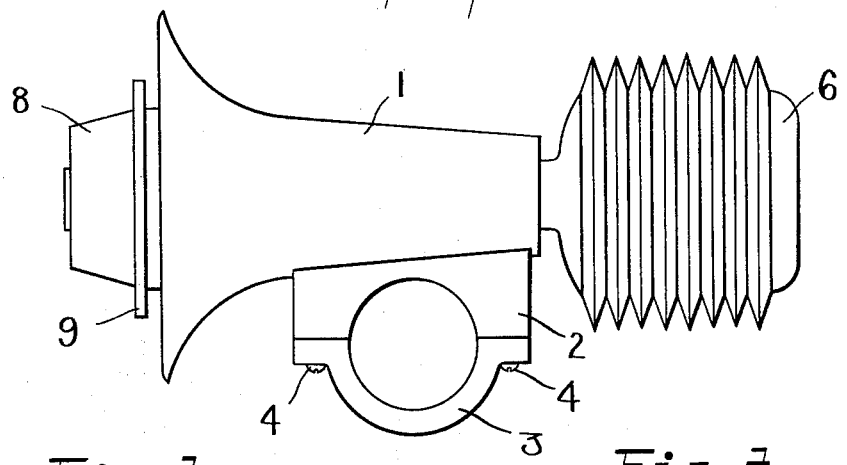
FIG. 1 is a side view showing a complete body of an alarm for a bicycle in accordance with the present invention.
Figure 2:
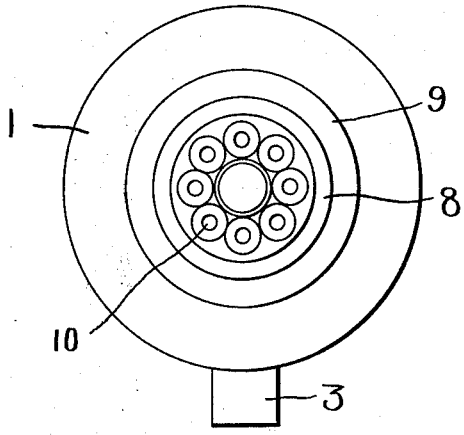
FIG. 2 is a front view of FIG. 1.

An alarm for a bicycle according to the present invention comprises a trumpet-like cylindrical body 1 made of a material such as plastic or the like, a mounting piece receptacle bed 2 formed integral with said trumpet-like cylindrical body, a vocal member 5 fixedly encased inwardly of a base portion in said cylindrical body, a bellows-like air blower bag 6, a cover member 8, and a mounting piece 3 disposed opposite said mounting piece receptacle bed 2 and secured to a handle or the like of the bicycle through screws 4.

Projections are provided inwardly of the base portion of the trumpet-like cylindrical body 1 to fixedly encase the vocal member 5. Also, stepped portions are formed in the other end of the trumpet-like portion to receive and join the cover member.

The mounting piece receptacle bed 2 is formed integral with the trumpet-like cylindrical body and provides grooves which retain seat plates 4' fitted with the screws 4. It is designed so that the mounting piece receptacle bed 2 and mounting piece 3 are made in the form of a semi-circle, respectively to form a single circle thereby in such a manner that the mounting piece 3 may be secured to the handle or the like of the bicycle through screws 4.

The vocal member 5 is fixedly encased on the projections formed inwardly of the base portion of the trumpet-like cylindrical body 1. This vocal member 5, which is composed of a thin sheet made of metal, is fixed on the projections formed inwardly of the base portion of said trumpet-like cylindrical body 1.

The bellows-like air blower bag 6, which is composed of a material such as relatively thin plastic, is received in one end of the trumpet-like cylindrical body 1 through a guide cylinder 7 and is firmly adhered by the adherent to maintain the air-tightness. Further, the open end of the bellows-like air blower bag 6 is close to and opposite the above-described vocal member 5.

Figure 3:
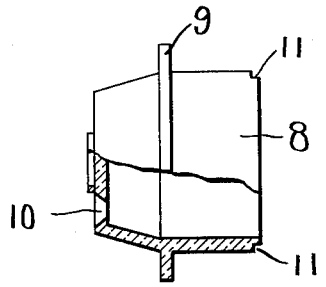
FIG. 3 is a side view partly broken of a cover member.

The cover member 8 of approximately inverted U-shaped in section, which is designed transparent or translucent in a sense of beauty, is formed with identical stepped portions 11 in the open end so as to correspond to those stepped portions formed in the other end of the aforesaid trumpet-like cylindrical body 1 and has a flange 9 and formed with a number of apertures 10 in a pointed fashion at the closed end (as shown in FIG. 3).

Figure 4:
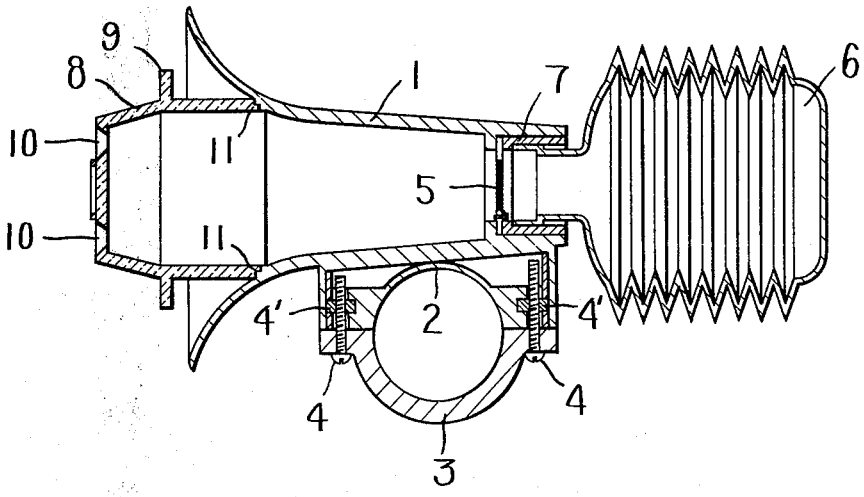
FIG. 4 is a longitudinal side view of FIG. 1.

It will therefore be appreciated in the present invention that since the cover member 8 formed with a number of apertures 10 is closely joined with the trumpet-like portion at the extremity of the trumpet-like cylindrical body 1 with said stepped portions applied with adherent or the like, the bellows-like air blower bag 6 may be compressed to left as viewed in FIG. 4 when said bag 6 is exteriorly depressed by hands or the like, to impart vibrations to the vocal member 5 due to internal air pressure thereby producing sounds and simultaneously therewith to raise the sounds due to the provision of the apertures formed in a pointed fashion.

Next, the bellows-like air blower bag 6 exteriorly released from depression resulted by release of hands tends to return to its initial state. In this case, air still remains within the trumpet-like cylindrical body 1 because of the above-described cover member 8 to thereby advantageously help said bag return to its initial state, and in addition, when the bag 6 is further moved back to its initial state, the vibrations may be imparted to the vocal member 5 to produce sounds due to the provision of a number of apertures 10 formed in a pointed fashion.

The alarm for a bicycle constructed as above has its entirety composed of a material such as plastic, which results in a reduced cost of manufacture, a provision of simple construction as well as readiness of operation.

According to the alarm of the present invention, air vibrations may be imparted to the vocal member in either case, that is, as the bellows-like air blower bag is biased and as it is moved back to its initial state, and moreover the alarm of the invention is capable of producing high sounds greater in the alarming effect.

What is claimed is:

1. An alarm for a bicycle wherein a vocal member is fixedly encased inwardly of a base portion in a trumpet-like alarm cylindrical body integrally provided with a mounting piece to be secured to a handle or the like of the bicycle and a mounting piece receptacle bed for supporting said mounting piece through screws and wherein a cover member of approximately inverted U-shaped in section, one end of which being closed and having a number of apertures formed in a pointed fashion, is adhered to a trumpet-like portion at the extremity of said cylindrical body which receives therein a bellows-like air blower bag through a guide cylinder.

* * * * *